US007264012B2

(12) United States Patent
Slade

(10) Patent No.: US 7,264,012 B2
(45) Date of Patent: Sep. 4, 2007

(54) SUPPORTED ROOF TARP APPARATUS

(76) Inventor: Eric J. Slade, P.O. Box 328, Vernon, VT (US) 05354

( * ) Notice: Subject to any disclaimer, the term of this patent is extended or adjusted under 35 U.S.C. 154(b) by 419 days.

(21) Appl. No.: 11/062,917

(22) Filed: Feb. 22, 2005

(65) Prior Publication Data

US 2006/0185706 A1 Aug. 24, 2006

(51) Int. Cl.
*E04H 15/16* (2006.01)

(52) U.S. Cl. ..... 135/94; 135/900; 135/96

(58) Field of Classification Search ..... 135/117, 135/94, 90, 91, 93, 121, 96, 900; 52/90.2, 52/3, 22, DIG. 12
See application file for complete search history.

(56) References Cited

U.S. PATENT DOCUMENTS

| | | | | |
|---|---|---|---|---|
| 1,619,740 | A * | 3/1927 | Long et al. | 135/142 |
| 2,434,685 | A * | 1/1948 | Claus | 135/149 |
| 3,805,816 | A | 4/1974 | Nolte | |
| 4,433,699 | A | 2/1984 | Schultes et al. | |
| 4,637,415 | A | 1/1987 | Dalo et al. | |
| 5,261,435 | A | 11/1993 | Stanley et al. | |
| 5,390,685 | A | 2/1995 | McCoy | |
| 5,613,543 | A | 3/1997 | Walton | |
| 5,799,680 | A | 9/1998 | Dorflinger | |
| 5,862,633 | A * | 1/1999 | Van Ells | 52/16 |
| 5,927,363 | A | 7/1999 | Olsen | |
| 5,930,971 | A | 8/1999 | Etheridge | |
| 6,273,115 | B1 | 8/2001 | Guggisberg | |
| 6,591,556 | B2 | 7/2003 | Bertheaume et al. | |
| 2002/0007924 | A1 | 1/2002 | Hendee | |
| 2005/0279393 | A1 * | 12/2005 | Tseng | 135/94 |

* cited by examiner

*Primary Examiner*—David Dunn
*Assistant Examiner*—Noah Chandler Hawk
(74) *Attorney, Agent, or Firm*—John J. Welch, Jr., Esq

(57) ABSTRACT

A supported roof tarp apparatus consisting of lengthwise and crosswise lying poles pinned together via four way connectors and pinning means and held at first ends of the lengthwise lying poles by roofing brackets positioned on a backside of a roof apex and held at second ends of the lengthwise lying poles by first vertically standing poles pinned after having been inserted within the second vertically standing poles held by a ground plate and guy wires to the ground with ground pinning means holding the ground plates and guy wires to the ground and a plurality of tarp components held by hook and fastener means to the lengthwise and crosswise lying poles with each tarp having slits cut into each about which flaps are stitched.

3 Claims, 12 Drawing Sheets

SUPPORTED ROOF TARP APPARATUS

CROSS REFERENCES TO PRIOR OR PARENT APPLICATIONS

Figure 1:
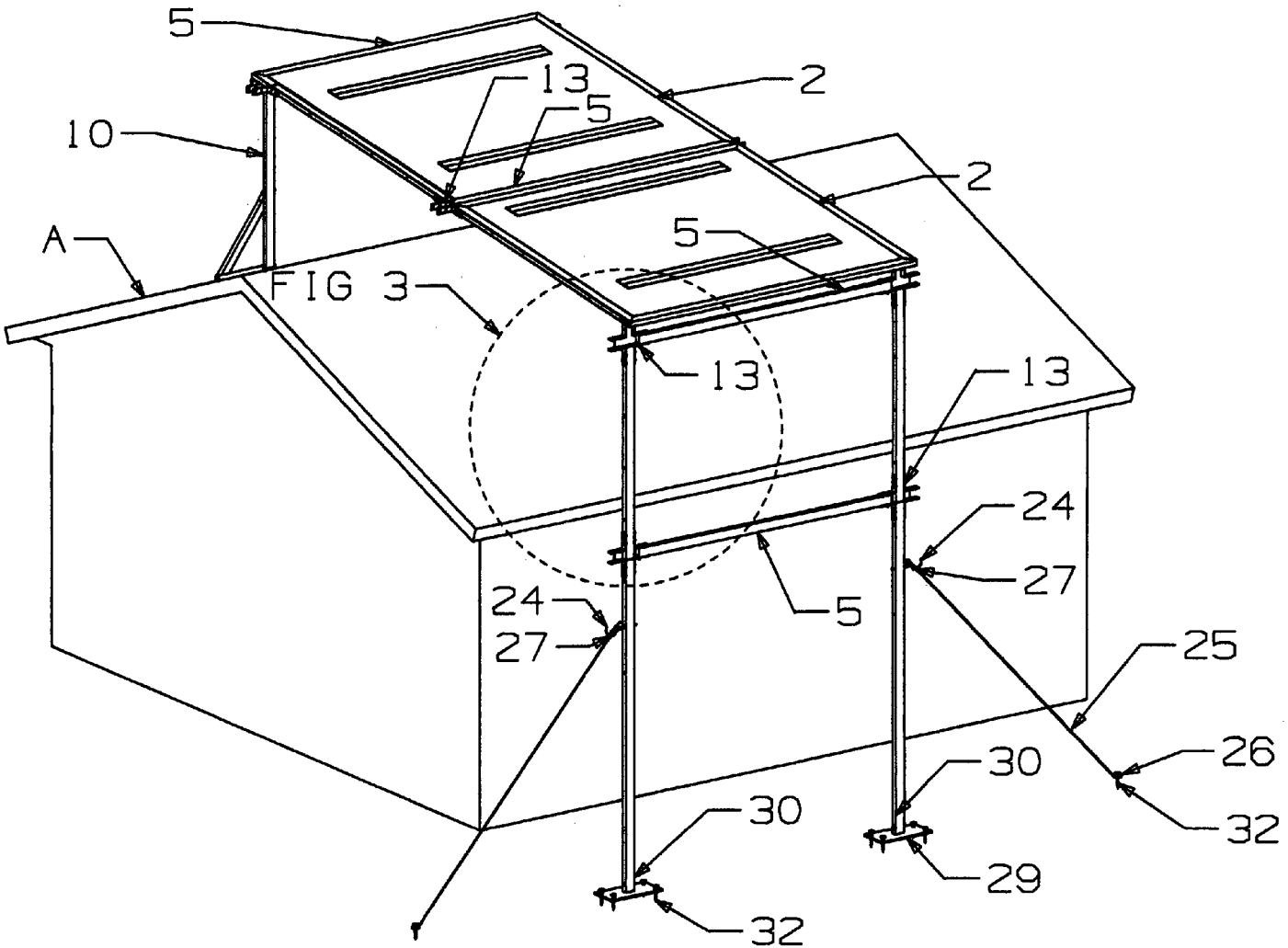

There are no prior or parent applications to which the present application relates.

FEDERALLY SPONSORED RESEARCH AND DEVELOPMENT

There is no federally sponsored research and development to which the present application relates.

BACKGROUND OF THE INVENTION

1. Field of the Invention

The present invention is one of those devices serving to facilitate the performance of work on roofs by roofing contractors.

2. Related Art

The matters set forth in the Art Information Statement that accompanies this application relate to the present invention, but, respectfully submitted, does not anticipate it.

A SUMMARY OF THE INVENTION

1. A Brief Description of the Invention:

The invention consists of support poles held above and parallel to the plane of a roof. The poles are held together lengthwise by four-way connector devices and pinning means inserted through holes in the connectors and the poles. There are poles lying crosswise that are likewise held in place in relationship with the lengthwise lying poles also by pinning means inserted through holes in the connectors and the crosswise lying poles. On the other side of the apex of the roof there are positioned a plurality of bracket components, the top vertices of which hold the first ends of the lengthwise lying poles via still other connectors and pinning means inserted through holes in the connectors and poles. The second ends of the lengthwise lying poles are held by pinning means through holes in yet other connectors and holes in first ends of first vertically standing poles. Each first vertically standing pole is in turn telescopically held within a second vertically standing pole by pinning means. Each second vertically standing pole is supported at ground level by way of a lower end thereof being placed over and onto a jutting upright member portion of a ground plate. The ground plates are in turn affixed to ground via other pinning means inserted through holes in the corners of the ground plates. All of the abovedescribed poles are hollow. In this way, for instance, the first vertically standing poles can be telescopically inserted into the second vertically standing poles to levels to accommodate the vertical distance as between the ground and a height of, for instance, six feet or so above the level of the plane of a roof. Eye hooks are attached to each second vertically standing pole. A guy wire is looped through each eye hook at one end thereof. The other end of each guy wire is pinned via pinning means to the ground. Each guy wire is pulled taut at the point of where each eyehook is found and looped through holes in a pincer trap serving to hold each guy wire back in such a taut position. The guy wires serve to facilitate the stability of the poles during windy weather. Overlapping the above-described lengthwise lying and crosswise lying poles are a plurality of tarp components when the invention is fully assembled about a roof. Each tarp is characterized by the presence of hook and fastener means about the perimeter of each to permit each one then being folded and held in place about the lengthwise lying poles. At each corner of each tarp is a slit to accommodate folding of each tarp lengthwise and crosswise about the lengthwise and crosswise lying poles. Each tarp component has cut into each a plurality of elliptically shaped slits about which flaps are stitched. The slits with flaps accommodate the flow of wind about the plane of the roof and the bottomsides of each installed tarp component. Wind blows up through the slits and separates the flaps. When the wind dies down, the flaps return to their original positions above and covering the slits.

2. Objects of the Invention:

Roofing installation and/or repair is indispensable work where building or housing construction or refurbishment are concerned. It is clearly necessary, once such work is started, to finish it in as short a time as possible in order to maintain commencement to completion endeavors consistent with the requirements of pre-ordained construction and/or repair schedules. However, oftentimes, the weather and the elements can invariably cause potentially expensive and clearly unwanted delays in terms of time needed to complete such work. The instant invention goes a very long way towards militating against the occurrences of any such delays such as would otherwise be prompted by adverse weather conditions. The instant invention serves to virtually neutralize in undoubtedly a most effective fashion, any propensity for any such delays such as would be prompted by any such adverse weather conditions such as, for example, a wind driven rainstorm.

In view of the foregoing, respectfully submitted, the instant invention is not only new, useful and unique, but indeed veritably revolutionary within the aegis of the art relating to the protection of roofers from the effects of adverse weather conditions such as might occur during the course of a roofing construction or repair endeavor.

A DESCRIPTION OF THE DRAWINGS

Figure 2:
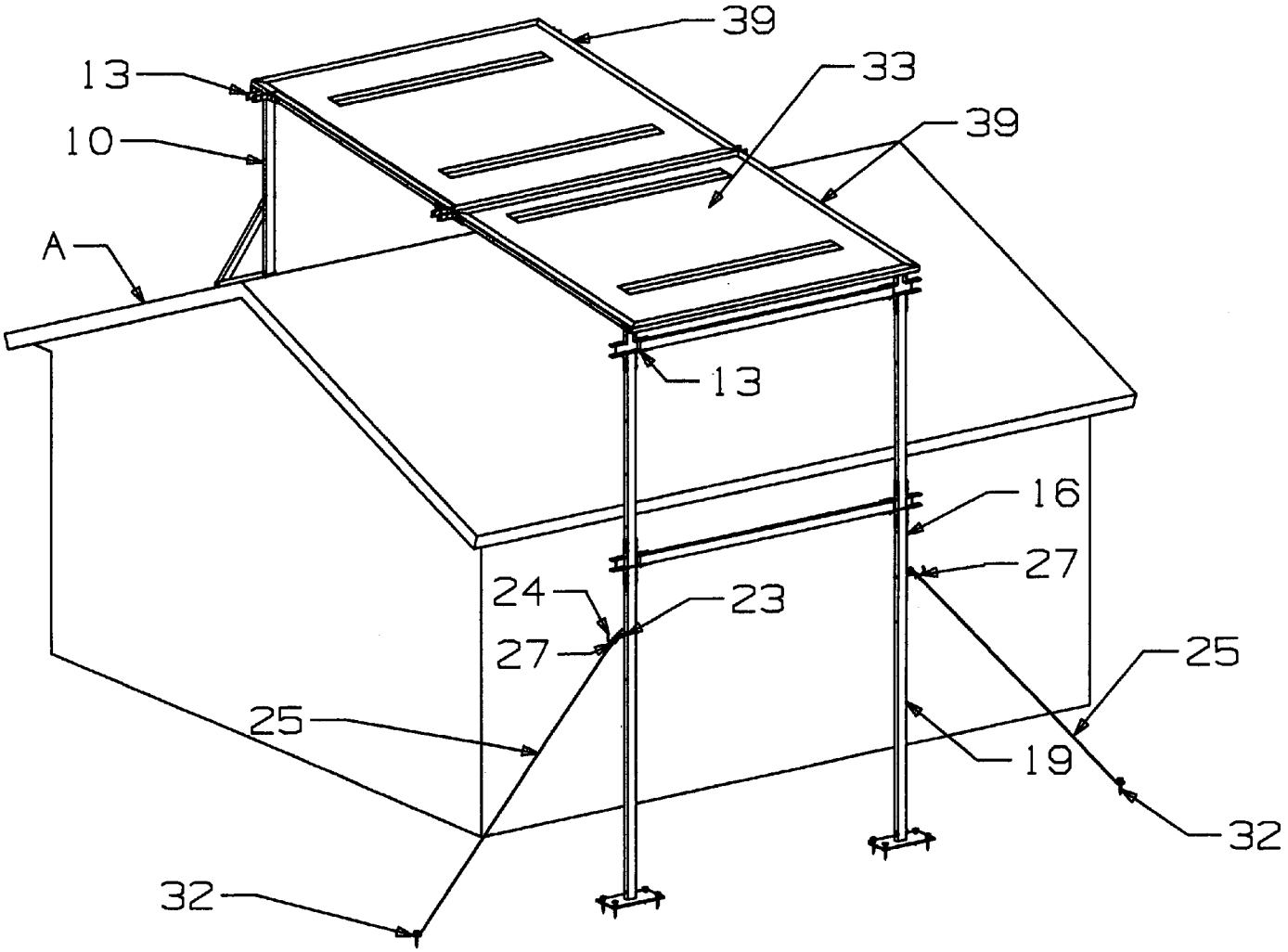
Figure 3:
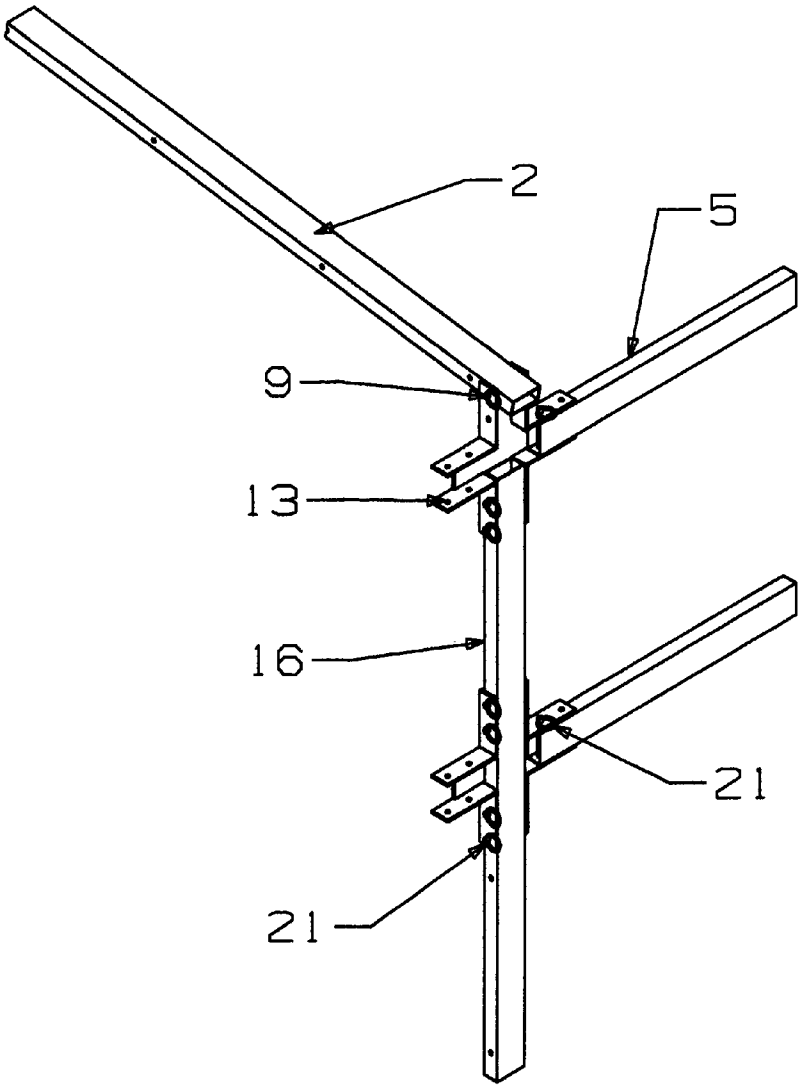
Figure 4:
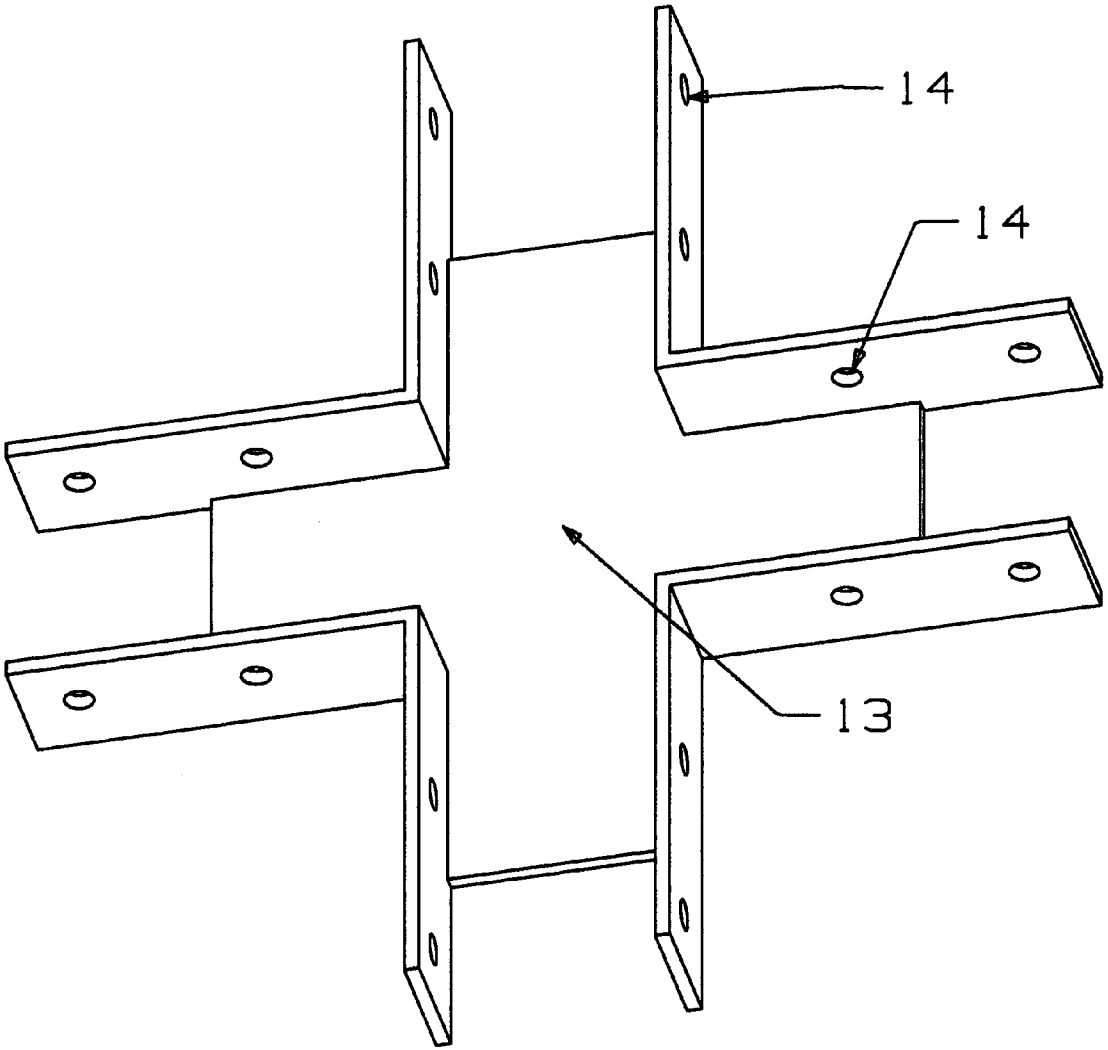
Figure 5:
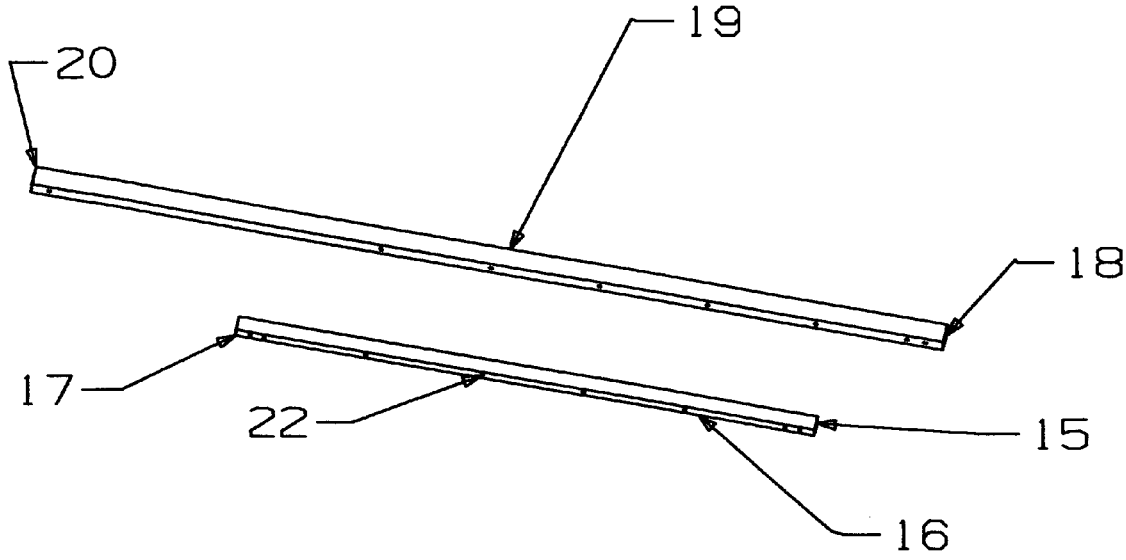
Figure 6:
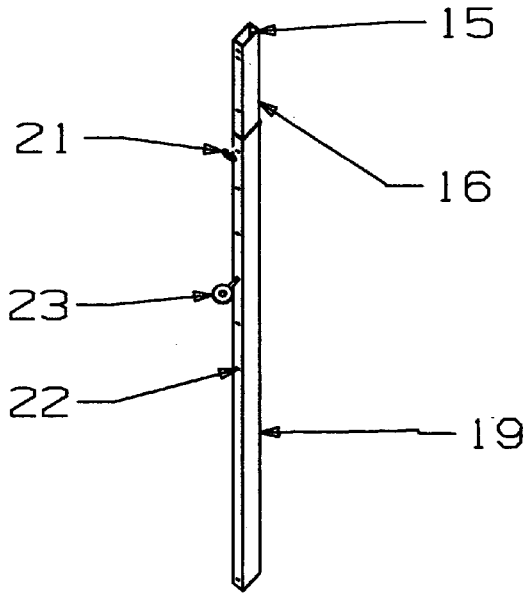
Figure 7:
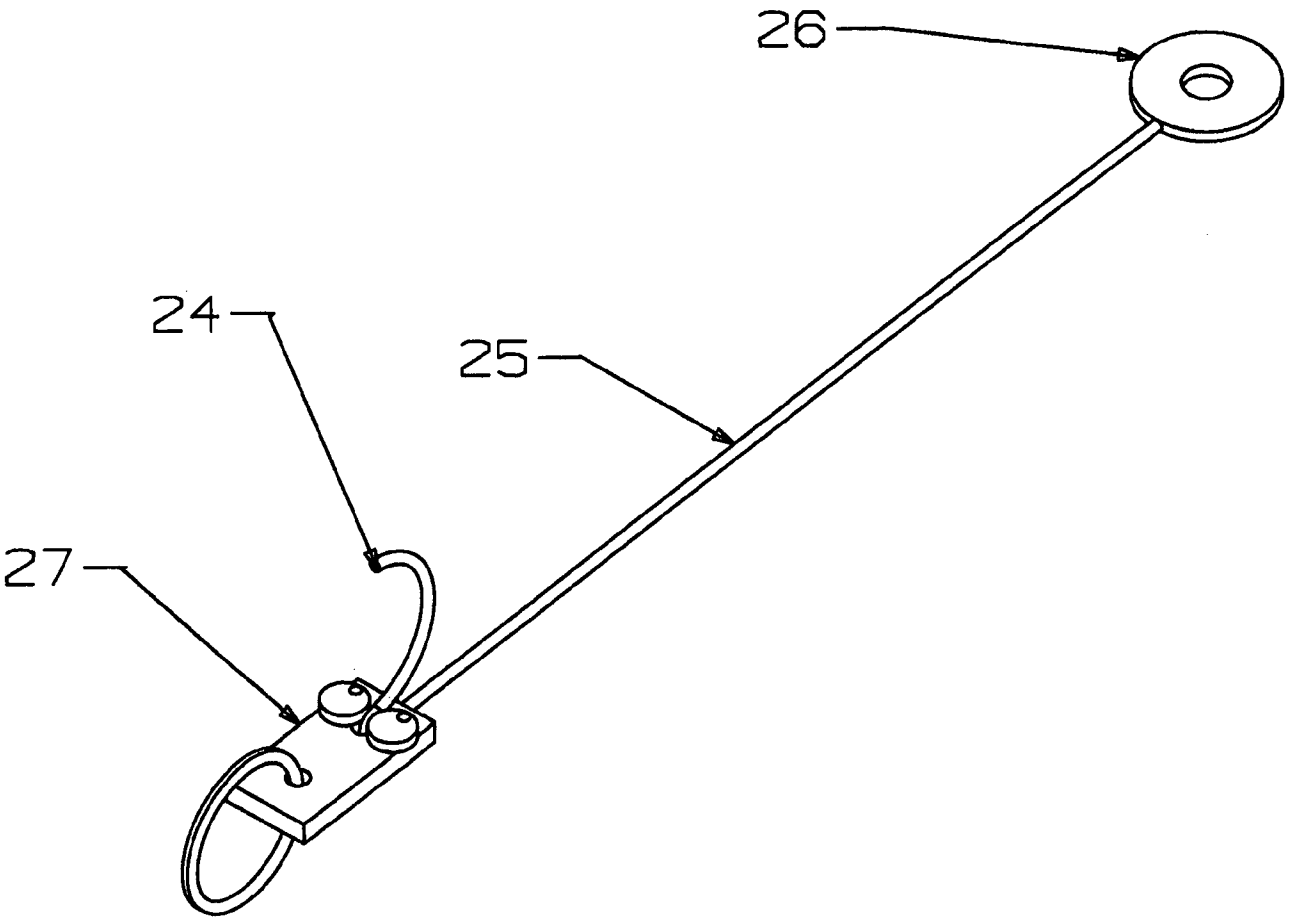
Figure 8:
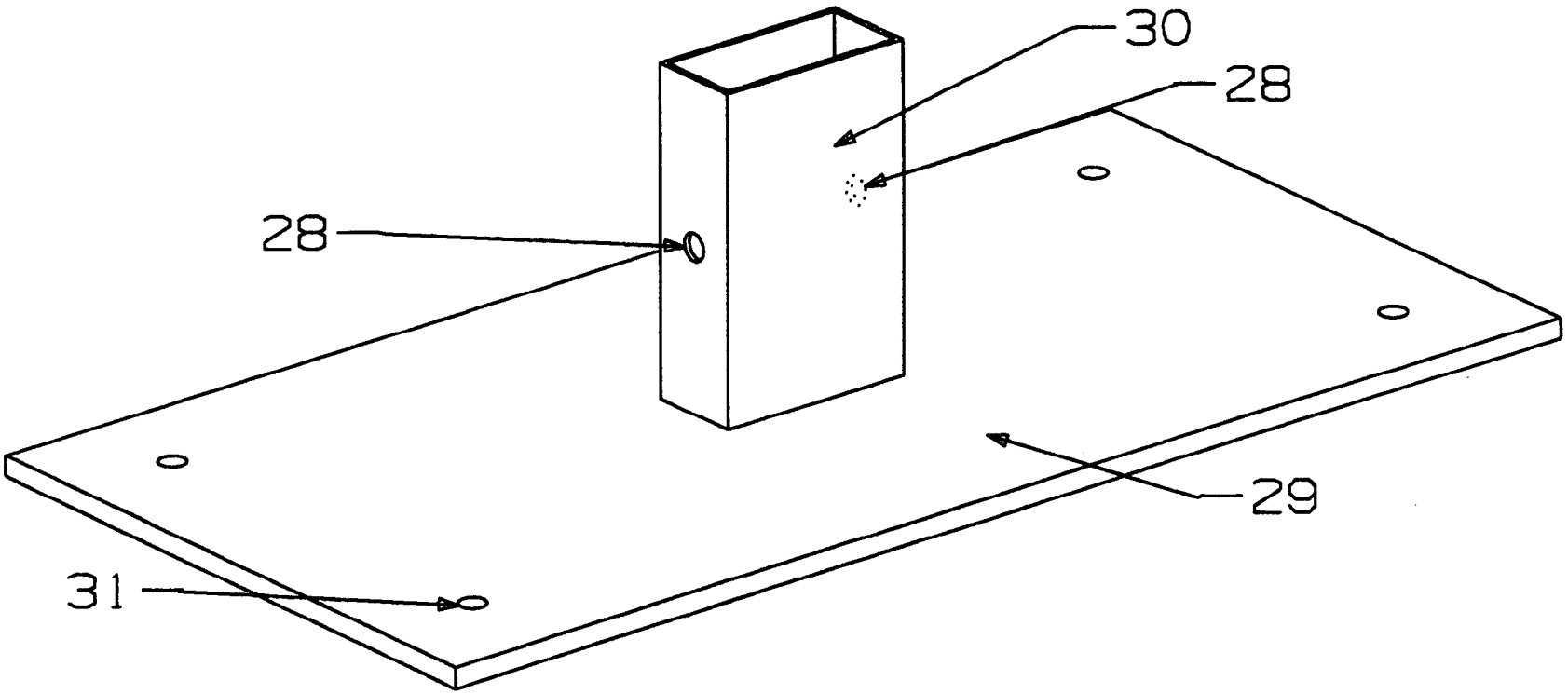
Figure 9:
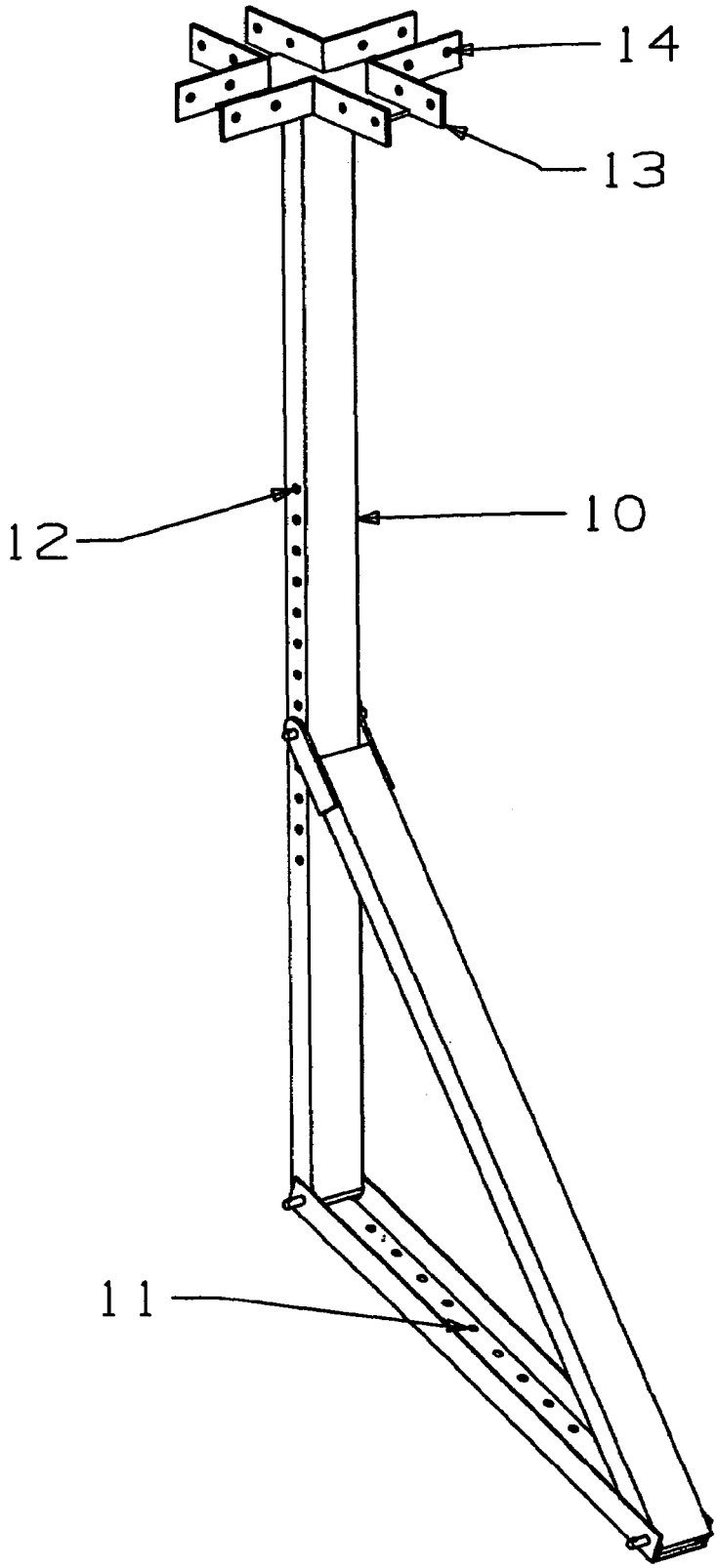
Figure 10:
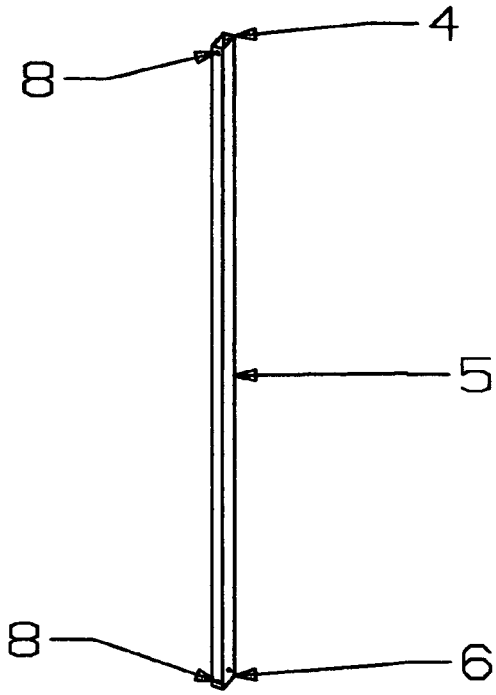
Figure 11:
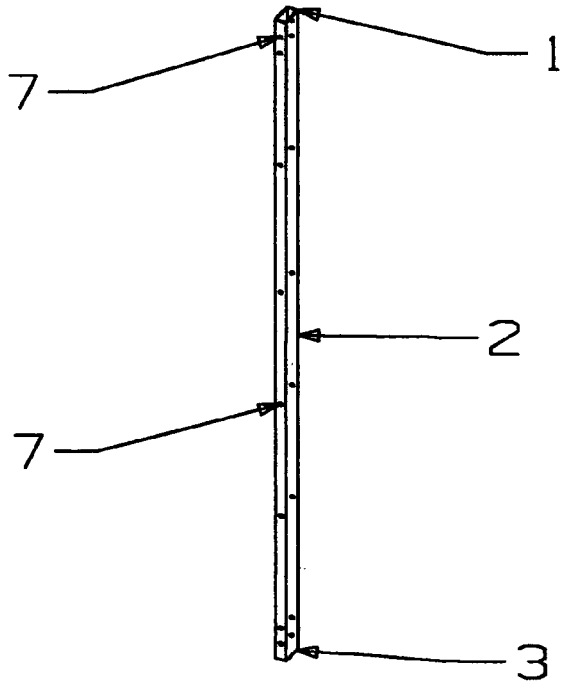
Figure 12:
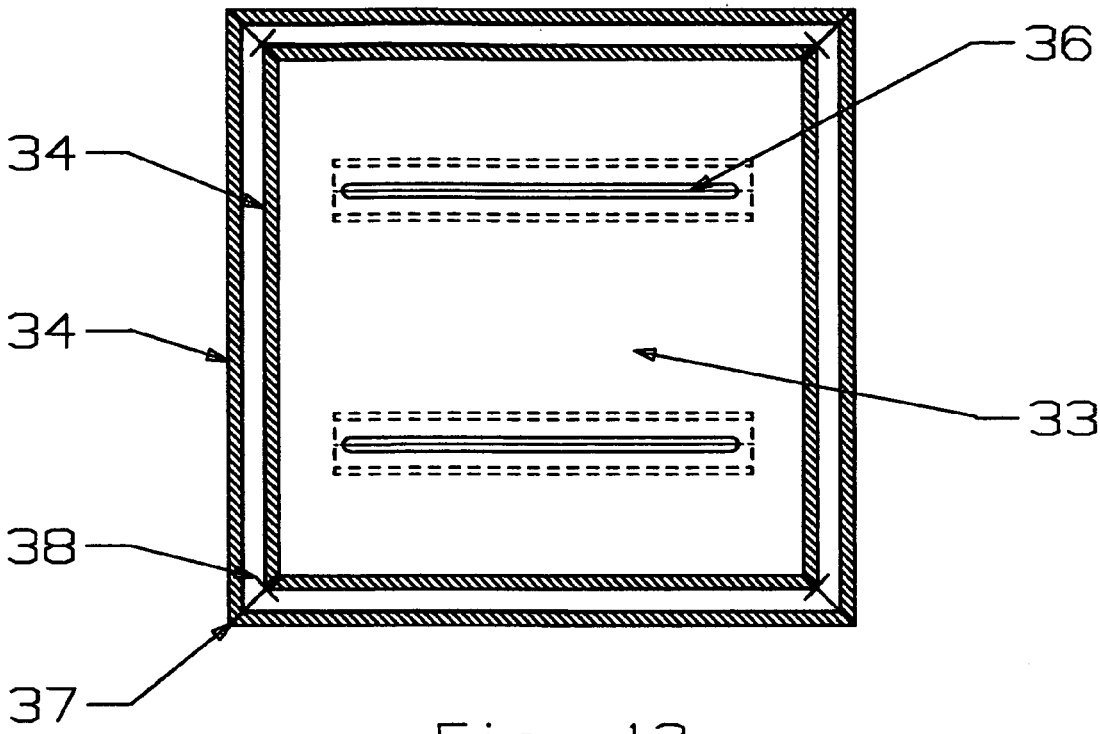

1. FIG. 1 is a perspective view of the support components of the instant invention.
2. FIG. 2 is a perspective view of the whole of the instant invention.
3. FIG. 3 is an isolated view of one anterior corner portion of the instant invention.
4. FIG. 4 is a top plan view of a four-way connector component of the instant invention.
5. FIG. 5 is an isolated view of a first vertically standing pole component and a second vertically standing pole component of the instant invention.
6. FIG. 6 is an isolated view of a first vertically standing pole inserted into a second vertically standing pole.
7. FIG. 7 is a perspective view of a guy wire component of the instant invention connected with a pincer trap component thereof.
8. FIG. 8 is a perspective view of a ground plate component of the instant invention.
9. FIG. 9 is a perspective view of a roofing bracket component of the instant invention.
10. FIG. 10 is a perspective view of a crosswise lying pole component of the instant invention.
11. FIG. 11 is a perspective view of a lengthwise lying pole component of the instant invention.
12. FIG. 12 is a bottom plan view of a tarp component of the instant invention.

Figure 13:
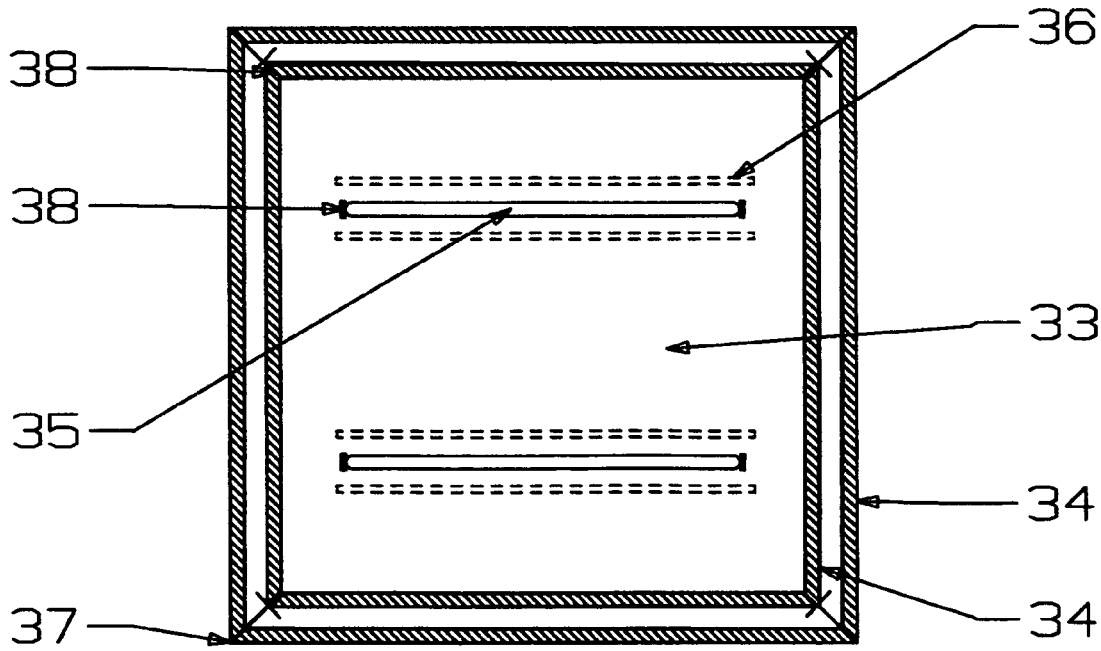

13. FIG. 13 is a bottom plan view of a tarp component of the instant invention showing flaps sewn thereto as being open.

Figure 14:
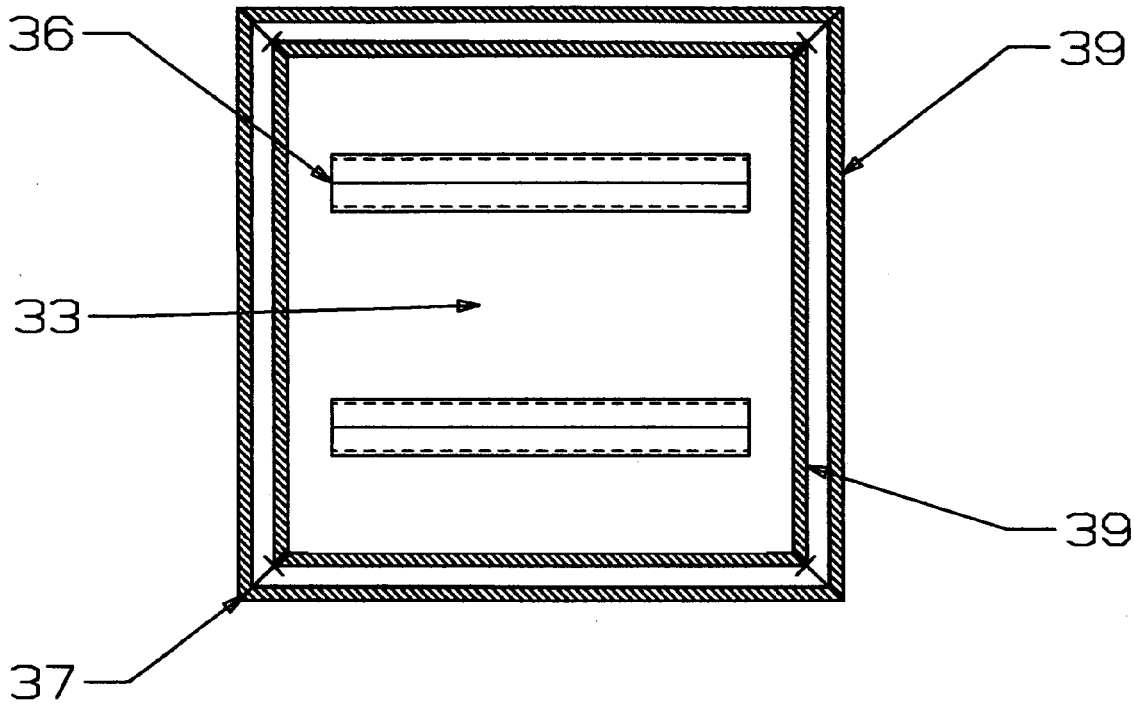

14. FIG. 14 is a top plan view of a tarp component of the instant invention.

Figure 15:
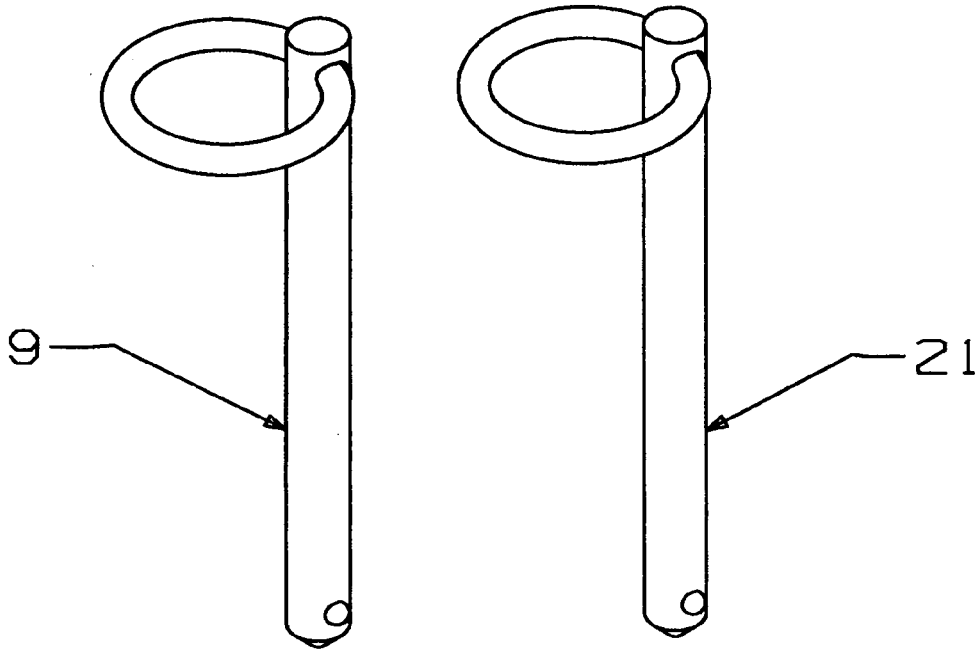

15. FIG. 15 is a perspective view of the equivalent pinning components of the instant invention.

Figure 16:
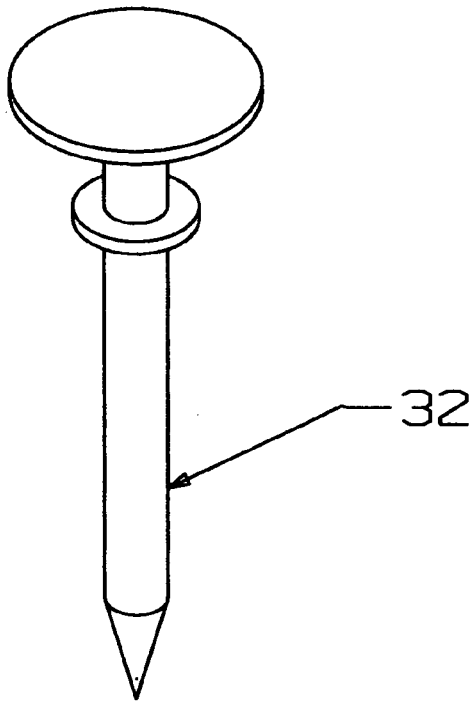

16. FIG. 16 is a perspective view of one of the equivalent ground plate pinning components of the instant invention.

A DESCRIPTION OF THE PREFERRED EMBODIMENTS OF THE INVENTION

FIG. 1 shows lengthwise lying poles 2, one of which is shown in FIG. 11. These poles are connected near first ends 1 thereof by pinning means 9 as seen in FIG. 15 to roofing brackets 10 via holes 12 in vertical legs of such brackets 10. Holes 11 in the bases of such brackets enable such brackets 10 to be nailed to roofing beyond the apex of a roof A as shown in FIGS. 1 and 2. A bracket 10 is shown in isolation in FIG. 9. Each of a plurality of four-way connector components 13 as seen in FIGS. 1, 2 and 9 serve to facilitate the connections of poles 2 to first ends 4 and second ends 6 of crosswise lying poles 5 all via pinning means 9 through holes 14 in brackets 10, holes 7 in poles 2 and holes 8 in poles 5. A pole 5 is depicted in FIG. 10. The lengthwise lying poles 2 are connected end to end via pinning means 9 through holes 7 in poles 2 and holes 14 in components 13. A four-way connector component 13 is shown in FIG. 4. FIG. 3 serves to illustrate how, at, for instance, one anterior corner portion of the invention, second ends 3 of poles 2 via pinning means 9 through holes 7, 14 and holes 22 in first ends 15 of first vertically standing poles 16 are ultimately connected to poles 16, one of which is shown in isolation in FIG. 5 along with the showing therein of a second vertically standing pole 19. Poles 16 are telescopically insertable into poles 19. Both poles 16 and 19 being hollow are then pinned together via pinning means 9 through holes 22 located respectively in second ends 17 of poles 16 and first ends 18 of poles 19. Such connection is shown in isolation in FIG. 6. An eyehook 23 is affixed to the exterior portion of each pole 19. A first end 24 of a piece of guy wire 25 is inserted through an eyehook 23 and then through a first and second opening of a pincer trap component 27 as shown in FIGS. 1, 2 and in particular FIG. 7. Guy wire 25 is in turn pinned to ground at a second end 26 thereof which is fashioned into the form a loop via vertical standing pole pinning means 32 as shown in FIG. 2. Second vertically standing poles 19 are supported by way of fitting them at second ends 20 thereof onto an upwardly jutting member 30 of a ground plate 29, one pole 19 per ground plate 29. FIG. 8 shows a ground plate 29 in isolation. Each ground plate 29 is pinned to ground via pinning means 32 shown in isolation in FIG. 16 which are inserted into ground via holes 31 in the corners of ground plates 29. Each upwardly jutting member 30, one of which is shown in FIG. 8 is rectangularly shaped so as to accommodate the rectangularly shaped poles 19 fitted thereon as mentioned above. Holes 28 in members 30 serve to receive vertical standing pole pinning means 21 shown in FIG. 15 where such means are first inserted through holes 22 near second ends 20 of poles 19 to further stabilize the connections of poles 19 to members 30. When all of the entire support components of the invention are assembled as shown in FIG. 1, first ends 24 of guy wires 25 are pulled taut through eyehooks 23 and the openings in trap components 27 after having been pinned with pinning means 32 inserted through looped ends 26 of guy wires 25 to ground to thereby more firmly stabilize connection of all of the same to ground. This feature of the invention serves to render the whole of it inherently more stable in a fully assembled state during windy conditions than it would be if merely connected to ground as mentioned above via fitting poles 19 over members 30. FIG. 12 shows in bottom plan view, a tarp component 33 of the invention. Tarp components 33 are shown in FIG. 2 assembled to poles 2 and poles 5 of the invention. Tarp slits 35 in tarp component 33 at the ends of which there is reinforcement stitching 38 in tarp components 33 are shown closed in FIG. 12 and open in FIG. 13, which is also a bottom plan view of a tarp component 33. FIG. 14, a top plan view of a tarp component 33 shows flaps 36 sewn to tarp component 33 and lying over tarp slits 35 thereby rendering the tarp slits 35 into the closed state such as is depicted from below in FIG. 12. Each corner of each tarp component 33 is characterized by the presence of a forty-five degree inclined corner slit 37 that is buttressed at an uppermost end thereof by reinforcement stitching 38 as can be seen with resort to FIGS. 12 and 13 respectively. Hook and fastener material 34 is affixed to and circumscribes the bottomside perimeters of tarp components 33 as seen in FIGS. 12 and 13. Hook and fastener material 39 is affixed to and circumscribes the topside perimeters of tarp components 33 as shown in FIG. 14. The purpose of the hook and fastener material 34 and 39 is to enable tarp components 33 to be wrapped about poles 2 and 5 in full assembly of the invention. Corner slits 37 allow for corner room when tarp components 33 are so affixed to poles 2 and 5. Stitching 38 prevents tearing of tarp components 33 at the apices of corner slits 37 just as such stitching 38 prevents ripping of tarp slits 35 at the ends thereof. Tarp slits 35 function to allow wind coming in over the roof A and below a tarp component 33 to be released up and out through tarp slits 35 thereby preventing in a truly meaningful way, such wind from otherwise disrupting the aforementioned manner of attachment of a tarp component 33 to poles 2 and 5. Flaps 36 are blown open as per what is shown in FIG. 13 by the force of such wind from below. Flaps 36 fall back over tarp slits 35 as can be seen in FIG. 12 when there is no wind blowing up from below through tarp slits 35. As can be seen moreover with resort to FIGS. 1 and 2, the fully assembled invention can be doubled or even tripled in size depending upon a roofer's needs predicated upon the size of a given roof A simply by assembling more poles 2 and 5 to what is already shown via yet more four way connector units 13 and affixation as described above and in turn to yet more first vertically standing poles 16 similarly connected to second vertically standing poles 19 in turn supported as described above. Yet another variant of the invention would be one whereby poles 2, 5, 16 and 19 along with upwardly jutting member 30 are cylindrically rather than rectangularly shaped. Moreover in respect of this variant of the invention, the tray portions of four way connector components would be semicircularly rather than rectangularly shaped.

In conclusion, once again; respectfully submitted, the instant invention is not only new, useful and unique, but indeed veritably revolutionary within the aegis of the art relating to the protection of roofers from the effects of adverse weather conditions such as might occur during the course of a roofing construction or repair endeavor.

What is claimed is:

1. A supported roof tarp apparatus, comprising:

a. a plurality of lengthwise lying poles;

b. a plurality of crosswise lying poles;

c. said lengthwise lying poles being connected near first ends thereof by pinning means through holes therein, to roofing brackets via holes located in said roofing brackets;

d. said roofing brackets being affixed via affixation means through holes in bases thereof to roofing located beyond an apex of a roof;

e. a plurality of four way connector components;

f. said crosswise lying poles being pinned via pinning means through holes therein at each end thereof, via holes in said four way connectors and via holes in said lengthwise lying poles, to each of said first ends and second ends of said lengthwise lying poles;

g. one of said ends of each of two of said lengthwise lying poles being pinned via holes therein, via holes in other said four way connectors and via holes near first ends of first hollow vertically standing poles to said first ends of said first vertically standing poles;

h. said first hollow vertically standing poles being affixed near second ends thereof within second hollow vertically standing poles via pinning means inserted through holes near said second ends of said first vertically standing poles and holes in said second vertically standing poles;

i. an eyehook affixed to an exterior portion of each of said second vertically standing poles;

j. a plurality of pieces of guy wire;

k. a first end of each of said pieces of guy wire being inserted through each of said eyehooks;

l. a pincer trap component with a first opening and a second opening found therein;

m. each of said first ends of each of said pieces of guy wire being held taut after having been inserted through each of said first openings and then each of said second openings in each of said pincer trap components;

n. each of said second hollow vertically standing poles being connected at bottom ends thereof to an upwardly jutting member of each of a plurality of ground plates;

o. a hole being located near each corner of each one of said plurality of ground plates;

p. ground plate pinning means inserted through each of said holes in said each one of said plurality of ground plates serving to affix said each one of said plurality of ground plates to ground;

q. a second end of each of said pieces of guy wire being looped and affixed via guy wire pinning means to said ground;

r. a plurality of tarp components;

s. a plurality of tarp slits being cut into each of said tarp components;

t. flap members stitched about each of said tarp slits to a topside of each of said tarp components;

u. reinforcement stitching within each of said tarp components abutting each end of each of said tarp slits;

v. hook and fastener means attached to, and circumscribing a bottomside perimeter of each of said tarp components for purposes of affixing each of said tarp components to said lengthwise lying poles and said crosswise lying poles;

w. second hook and fastener means attached to a topside of each of said tarp components;

x. each corner of each of said tarp components being characterized by a nearly forty-five degree corner slit therein, and;

y. said each corner of said each of said tarp components being further characterized by the presence of reinforcement stitching at apices of each said nearly forty-five degree corner slits.

2. The supported roof tarp apparatus of claim 1 whereby said upwardly jutting member of said each of a plurality of ground plates and each of said lengthwise lying poles, said crosswise lying poles, said first hollow vertically standing poles and said second hollow vertically standing poles thereof are rectangularly shaped.

3. The supported roof tarp apparatus of claim 1 whereby said upwardly jutting member of said each of a plurality of ground plates and each of said lengthwise lying poles, said crosswise lying poles, said first hollow vertically standing poles and said second hollow vertically standing poles thereof are cylindrically shaped.

* * * * *